US009628207B2

(12) United States Patent
Emani et al.

(10) Patent No.: US 9,628,207 B2
(45) Date of Patent: Apr. 18, 2017

(54) INTELLIGENT SWITCHING OF AUDIO SOURCES

(71) Applicant: GM Global Technology Operations LLC, Detroit, MI (US)

(72) Inventors: Sitaram Emani, Farmington Hills, MI (US); Tarun Inabathuni, Farmington Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 127 days.

(21) Appl. No.: 14/046,330

(22) Filed: Oct. 4, 2013

(65) Prior Publication Data

US 2015/0098584 A1 Apr. 9, 2015

(51) Int. Cl.

| | |
|---|---|
| ***H04H 60/12*** | (2008.01) |
| ***H04R 3/00*** | (2006.01) |
| *H04H 20/24* | (2008.01) |
| *H04H 60/51* | (2008.01) |

(52) U.S. Cl.

CPC ..... *H04H 60/12* (2013.01); *H04R 3/00* (2013.01); *H04H 20/24* (2013.01); *H04H 60/51* (2013.01); *H04R 2420/01* (2013.01); *H04R 2499/13* (2013.01)

(58) Field of Classification Search

CPC ..... H04B 1/082; H04H 20/26; H04H 60/85; H04H 60/12; H04H 60/51; H04H 20/24; H04W 4/021; H02W 4/022

USPC ..... 381/81, 123, 86; 455/67.7, 179.1

See application file for complete search history.

(56) References Cited

U.S. PATENT DOCUMENTS

| | | | | |
|---|---|---|---|---|
| 2003/0054758 | A1* | 3/2003 | Kawamata | H04H 20/106 455/3.04 |
| 2004/0156514 | A1* | 8/2004 | Fletcher | H04R 5/04 381/86 |
| 2006/0136967 | A1* | 6/2006 | Hellman | G11B 27/105 725/62 |
| 2006/0223467 | A1 | 10/2006 | Mason | |
| 2008/0015860 | A1* | 1/2008 | Lane | G10L 13/047 704/258 |
| 2008/0086266 | A1* | 4/2008 | Howard | G07C 5/008 701/469 |

(Continued)

FOREIGN PATENT DOCUMENTS

| | | | |
|---|---|---|---|
| CN | 101142772 | A | 3/2008 |
| CN | 101867731 | A | 10/2010 |

OTHER PUBLICATIONS

Chinese Office Action for Application No. 201410516494.9; dated Mar. 3, 2016; 8 pgs.

*Primary Examiner* — Thomas Alunkal
(74) *Attorney, Agent, or Firm* — Cantor Colburn LLP

(57) ABSTRACT

Intelligent switching of audio sources includes determining, via a computer processor communicatively coupled to an audio system in a vehicle, alternative sources of content that are communicatively available to the vehicle. The audio system renders an instance of a content item that has been received from a content provider, as a source of content, over a network. Upon determining an interruption in a signal from the content provider with respect to the instance of the content item, the intelligent switching of audio sources also includes presenting an alternative content item, through the audio system, from one of the alternative sources of content.

18 Claims, 2 Drawing Sheets

(56) References Cited

U.S. PATENT DOCUMENTS

| | | | | |
|---|---|---|---|---|
| 2009/0135757 | A1* | 5/2009 | Lee | H04B 7/18582 370/316 |
| 2009/0257602 | A1 | 10/2009 | Darby et al. | |
| 2010/0151840 | A1* | 6/2010 | Bauchot | H04M 3/4872 455/414.1 |
| 2012/0129476 | A1* | 5/2012 | Whikehart | H04B 1/082 455/179.1 |
| 2012/0209519 | A1* | 8/2012 | Basnayake | G01C 21/32 701/457 |
| 2013/0198737 | A1* | 8/2013 | Ricci | G06F 13/14 717/174 |
| 2014/0120842 | A1* | 5/2014 | Helm | G08G 1/0968 455/67.7 |

* cited by examiner

INTELLIGENT SWITCHING OF AUDIO SOURCES

FIELD OF THE INVENTION

The subject invention relates to vehicle audio systems and, more particularly, to intelligent switching of audio sources in a vehicle.

BACKGROUND

Most vehicles today have some type of audio system installed, e.g., from basic AM/FM broadcast-based radios to sophisticated infotainment systems that provide not only over-the-air broadcast music and programming, but also Internet radio, as well as on-board content through recordable computer mediums (e.g., hard disks), and content delivered from wireless portable devices in the vehicle.

With regard to externally sourced content, when a wireless transmission signal from a satellite- or terrestrial-based system is obstructed, e.g., when the vehicle is operating within a tunnel or in a parking garage, or when a weather-related event disrupts the signal, the audio system may display a message in the vehicle indicating that no signal is available. In this situation, the currently obstructed signal will not be available until the vehicle moves away from the obstruction.

With the vast number of different sources of content currently available, it would be desirable to provide options for a vehicle operator or occupant when a signal is interrupted.

SUMMARY OF THE INVENTION

In one exemplary embodiment of the invention, a system is provided. The system includes a computer processor communicatively coupled to an audio system in a vehicle. The audio system renders an instance of a content item that is received from a content provider, as a source of content, over a network. The system also includes logic executable by the computer processor. The logic is configured to implement a method. The method includes determining alternative sources of content that are communicatively available to the vehicle. Upon determining an interruption in a signal from the content provider with respect to the instance of the content item, the method includes presenting an alternative content item, through the audio system, from one of the alternative sources of content.

In another exemplary embodiment of the invention, a method is provided. The method includes determining, via a computer processor communicatively coupled to an audio system in a vehicle, alternative sources of content that are communicatively available to the vehicle. The audio system renders an instance of a content item that is received from a content provider, as a source of content, over a network. Upon determining an interruption in a signal from the content provider with respect to the instance of the content item, the method includes presenting an alternative content item, through the audio system, from one of the alternative sources of content.

In yet another exemplary embodiment of the invention, a computer program product is provided. The computer program product includes a computer readable storage medium having instructions embodied thereon, which when executed by a computer processor, cause the computer processor to implement a method. The method includes determining alternative sources of content that are communicatively available to a vehicle. The computer processor is communicatively coupled to an audio system in the vehicle. The audio system renders an instance of a content item that is received from a content provider, as a source of content, over a network. Upon determining an interruption in a signal from the content provider with respect to the instance of the content item, the method includes presenting an alternative content item, through the audio system, from one of the alternative sources of content.

The above features and advantages and other features and advantages of the invention are readily apparent from the following detailed description of the invention when taken in connection with the accompanying drawings.

BRIEF DESCRIPTION OF THE DRAWINGS

Other features, advantages and details appear, by way of example only, in the following detailed description of embodiments, the detailed description referring to the drawings in which.

DESCRIPTION OF THE EMBODIMENTS

Figure 1:
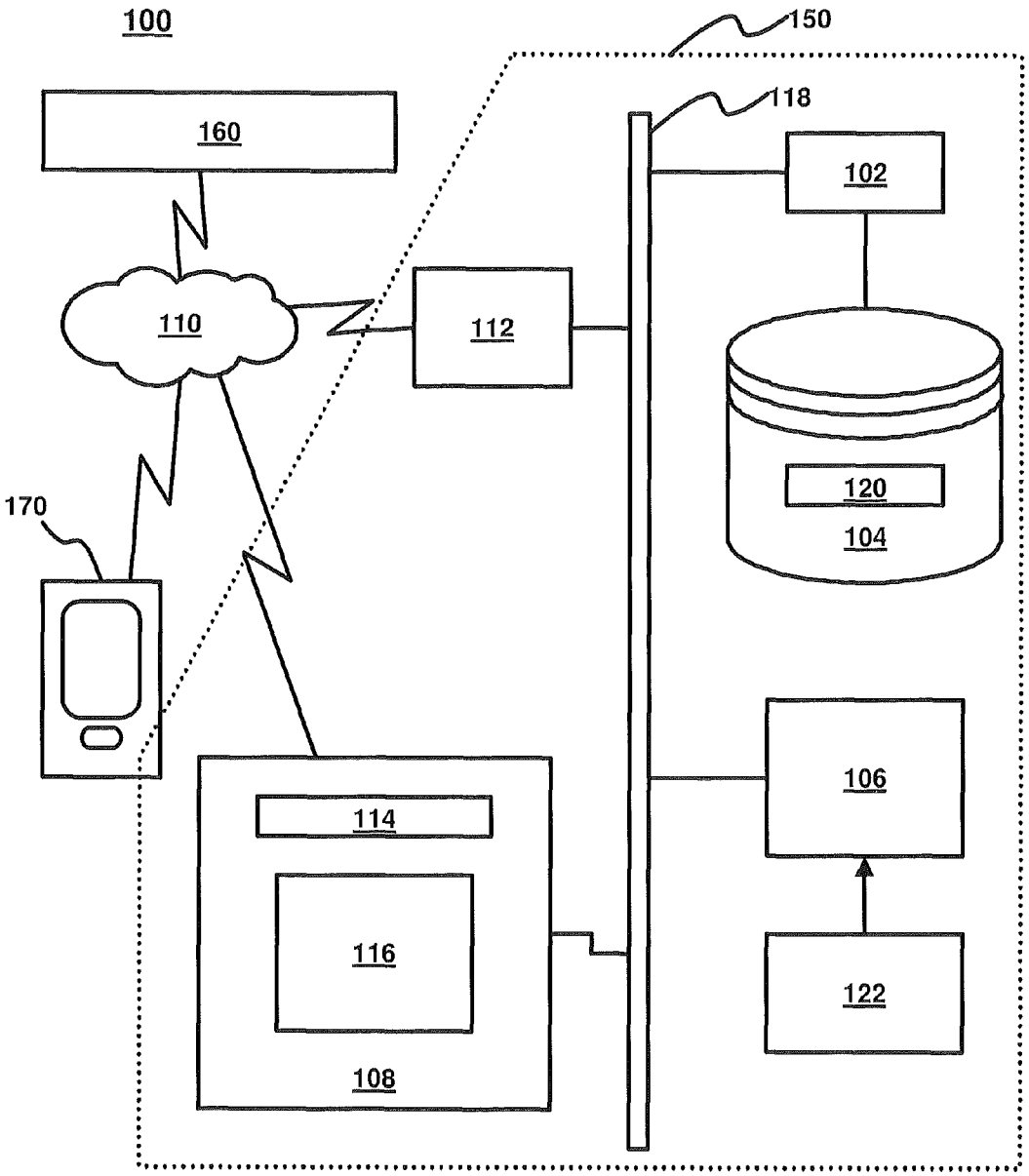
FIG. 1 is a diagram depicting a system upon which intelligent switching of audio sources may be implemented in accordance with an embodiment.

The following description is merely exemplary in nature and is not intended to limit the present disclosure, its application or uses. It should be understood that throughout the drawings, corresponding reference numerals indicate like or corresponding parts and features.

In accordance with an exemplary embodiment of the invention, intelligent switching of audio sources for content presented in a vehicle is provided. The intelligent switching of audio sources provides alternatively-sourced content for a vehicle when a current content signal to the vehicle is interrupted or is anticipated to be interrupted based on known or identified signal transmission obstructions, e.g., a parking garage, tunnel, etc.

The system 100 of FIG. 1 includes a portion of a vehicle 150, content provider system(s) 160, and a wireless device 170, each of which is communicatively coupled to network(s) 110.

The content provider system(s) 160 represent sources of content, such as broadcast radio stations and digital content providers (e.g., satellite radio providers). The content may include programming, music, news, or other information. In an embodiment, the content provider system(s) 160 stream content over one or more of the network(s) 110 to recipients (e.g., the vehicle 150), which content includes content files in addition to supplemental information. Supplemental information may include metadata that identifies the item of content (e.g., a title of a program, book, or song; composer, author, narrator, etc.), as well as the size of the content file and any other information attributable to describing the item of content. In addition, supplemental information may include a listing that identifies a sequential ordering of the content items scheduled for broadcast and may further include scheduled times of playing the content items.

The wireless device 170 may be a cellular telephone with enhanced functionality (e.g., a smart phone), and the device 170 may be operated by an occupant of the vehicle 150. The wireless device 170 may be configured with various communication protocols for enabling wireless communication with the vehicle 150. For example, the communication protocols may include Wi-fi, Bluetooth®, and/or cellular communications protocols. In another embodiment, communications between the wireless device 170 and the vehicle may occur in a wired fashion (e.g., via a universal serial bus (USB cable) between the device 170 and a corresponding input port in the vehicle 150).

In an embodiment, the wireless device 170 stores a listing of content items, such as playlists, music files, audio books, and/or programs, which may be stored in a variety of formats, such as .mp3, .wav, .amr, etc. In a further embodiment, the wireless device 170 may execute an application for enabling a user of the device 170 to stream Internet radio (e.g., Pandora®) over the network(s) 110 to the device 170.

The vehicle 150 includes a computer processor 102, a storage device 104, a display device 106, an audio system 108, and a wireless interface 112, each of which is communicatively coupled to a vehicle network 118.

The computer processor 102 may be part of the vehicle's control system hardware or may be part of an infotainment system in the vehicle 150. The computer processor 102 executes logic 120 for implementing the intelligent switching of audio sources described herein. The logic 120 is stored in the storage device 104.

In an embodiment, the computer processor 102 may also execute an encryption algorithm for facilitating a secured pairing between the wireless device 170 and the vehicle 150 (e.g., via Bluetooth protocols), such that the wireless device 170 can communicate with the vehicle 150, e.g., implement cellular voice communications. In addition, the communication between the wireless device 170 and the vehicle 150 may include transmitting content from the wireless device 170 (e.g., content stored on the wireless device or content streamed from an external source to the wireless device 170). The transmission of the content from the wireless device 170 and the vehicle 150 may be implemented over a short-range wireless network (e.g., Wi-Fi) or may be implemented in a wired fashion through a USB cable.

The display device 106 may be implemented as part of an infotainment system or navigation system of the vehicle 150. The display device 106 includes a display monitor and input components for enabling a user to select settings for features of the intelligent switching of audio sources, as will be described further herein. The display device 106 displays a user interface screen 122 for entering and viewing these settings.

The wireless interface 112 enables the vehicle 150 to communicate with external sources, such as the content provider system(s) 160 and the wireless device 170. In one embodiment, the wireless interface 112 may be a transceiver configured as part of a telematics system (e.g., OnStar®). The wireless interface 112 may communicate with the content provider system(s) 160 and/or wireless device 170 using an applicable network protocol (e.g., GSM, CDMA, 3G, HSPA+, 4G, LTE, etc.) and any wireless protocol as described above.

The audio system 108 is communicatively coupled to the network(s) 110, either through the vehicle network 118 and wireless interface 112, or through a separate wireless connection. The audio system 108 may be part of an infotainment system of the vehicle 150. The audio system 108 includes a short range wireless radio 114 (such as Wi-Fi-enabled radio).

While not specifically shown for ease of illustration, the vehicle 150, e.g., through an infotainment system, may include additional components, such as a deck, tuner, audio system devices including speakers, microphones, and amplifiers for enabling audio and other entertainment features to a user. As shown in FIG. 1, the audio system 108 also includes a digital media player system 116. The digital media player system 116 may include storage for housing content stored by a user. For example, the digital media player system 116 may include a disk drive for receiving a computer readable medium having content files stored thereon, which when engaged in the disk drive, execute the content files in cooperation with user-entered selections. In one embodiment, the digital media player system 116 may include multiple disk drives for simultaneously receiving a number of computer readable media.

The display device 106 may display information through the infotainment features offered by the audio system 108, such as radio data (e.g., station identifier and song track information for a currently tuned in music station), recorded data from a computer medium engaged in the digital media player system 116 (e.g., track number, song title, etc. for recorded music), and/or navigation system information for a global positioning system (GPS), to name a few. The CPU 102 may receive and process commands to and from the audio system 108, as well as provide routing information and/or turn-by-turn directions for a navigation system that are displayed on the display device 106. The various vehicle components described above may communicate with one another over the vehicle network 118.

The network(s) 110 may include any types of known networks in the art. For example, the network(s) 110 may be a combination of public (e.g., Internet), private (e.g., local area network, wide area network, virtual private network), and may include wireless and wireline transmission systems (e.g., satellite, cellular network, terrestrial networks, etc.).

The vehicle network 118 may include any combination of wired or wireless communication channels. For example, the vehicle network 118 can include a single communication bus or a combination of various communication buses that are implemented according to vehicle communication network standards, such as, for example, Controller Area Network (CAN), Society of Automotive Engineers (SAE) J1850, and General Motors Local Area Network (GMLAN), Media Oriented Transport Systems (MOST), etc.

Figure 2:
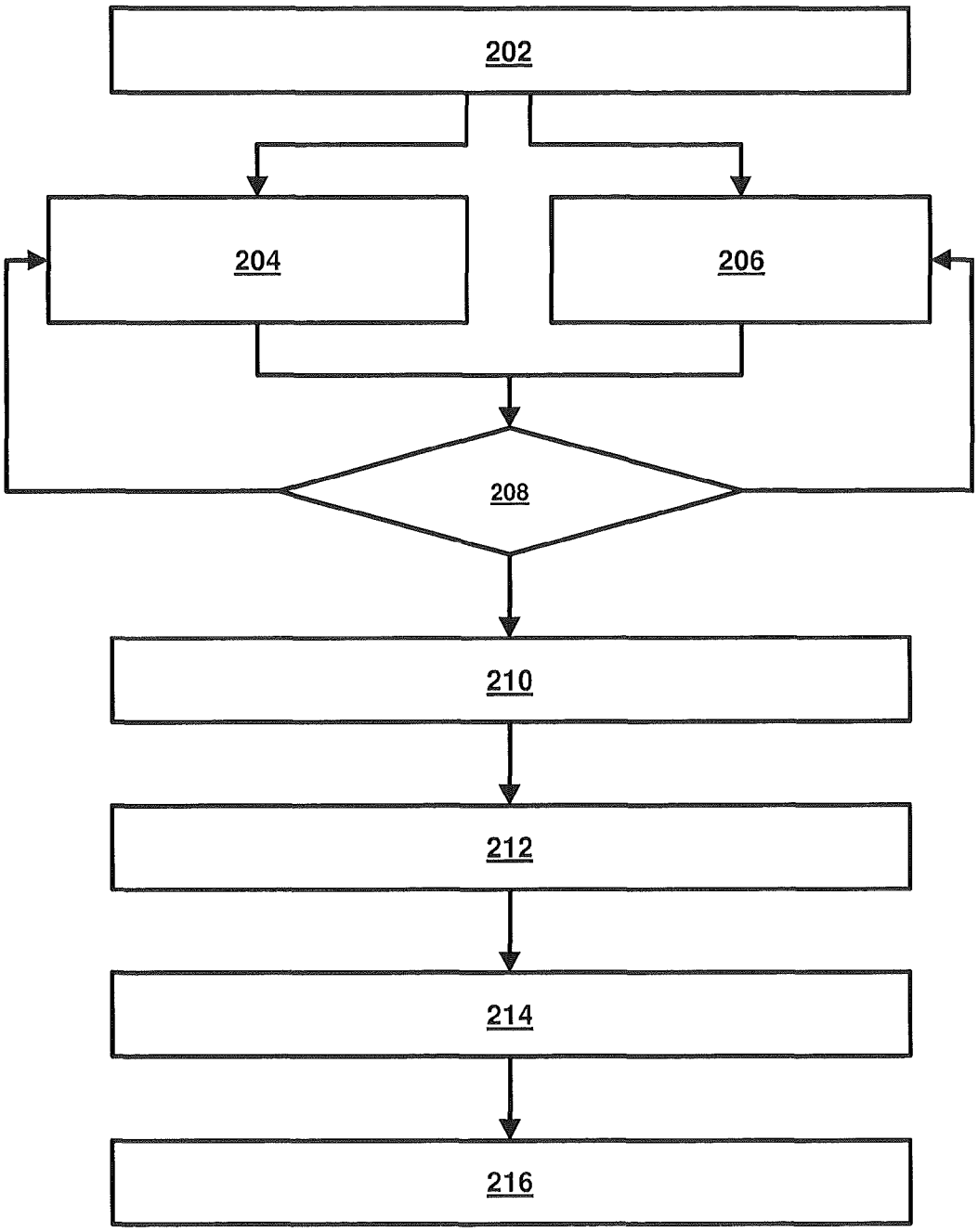
FIG. 2 is a flow diagram of a process for implementing intelligent switching of audio sources in accordance with an embodiment.

Turning now to FIG. 2, a process for implementing intelligent switching of audio sources will now be described in an embodiment. The process of FIG. 2 assumes that the vehicle 150 is active and in operation, and an instance of a content item, as well as supplemental information about the content item, which is transmitted by one of the content provider system(s) 160 to the wireless interface 112 or the audio system 108, is currently presented on a radio in the vehicle 150.

At step 202, the logic 120 determines the identity of the content item (e.g., program title, song title, or any other identification, such as an alphanumeric identifier assigned to the content item).

At step 204, the logic 120 monitors the signal quality of the current instance of the content item. Alternatively, the logic 120 may use navigation or routing information to determine a signal quality trigger event, e.g., an anticipated interruption in the signal based on known or identified obstructions (e.g., tunnel, mountain pass, weather conditions, etc.) determined from the navigation or routing information, and based on the current speed of the vehicle 150 as it approaches the obstruction.

At step 206, which may be implemented simultaneously with step 204, the logic 120 may determine alternative sources of content. For example, the logic 120 may access the functionality of the wireless interface 112 to scan for alternative transmission signals from available content sources. In one embodiment, the logic 120 scans the alternative sources of content for the identification of the currently presented content item. The alternative sources of content may be one or more of the content provider system(s) 160, the wireless device 170, and/or the digital media player system 116.

At step 208, it is determined whether a signal trigger event has occurred. The event may be the actual interruption of the transmission signal for the currently presented content item, or it may be an anticipation of an immediately pending interruption in signal based on, e.g., the navigation information or weather information.

If no trigger event has occurred at step 208, the process returns to steps 204 and 206. Otherwise, if the event has occurred, at step 210, the logic 120 identifies a location in the current instance of the content item in which the interruption has occurred or is expected to occur.

At step 212, the logic 120 identifies, if available, one of the alternative sources of content having the identifier of the currently playing content item. The content item (from an alternative source of content) having the identifier is referred to herein as a second instance of the content item.

At step 214, the logic 120 scans the second instance of the content item for the location (from step 210) of the interruption. In step 216, the logic 120 selects the second instance of the content item for play in the vehicle 150 beginning at the identified location, such that there is no apparent interruption perceived by the vehicle occupant of the content item.

In an embodiment, if no matching identification of the content item is found (at step 212), the logic 120 may select another content item for presentation. For example, the intelligent switching of audio sources enables a user to select preferences via the user interface screen 122 in the vehicle 150. In one example, the user may select which sources of content should be accessed by the logic 120 when the signal event occurs. In another example, the user may select what content may be used for replacement if a search of the alternative content sources does not yield a matching identifier (i.e., the search does not result in finding the same content item). In an embodiment, the user may select an option to replace interrupted content with content items from the same author, composer, or artist of the content item that was interrupted.

Technical effects of the embodiments of the invention include intelligent switching of audio sources for content presented in a vehicle. The intelligent switching of audio sources provides alternatively-sourced content for a vehicle when a current content signal to the vehicle is interrupted or is anticipated to be interrupted based on known or identified signal transmission obstructions, e.g., a parking garage, tunnel, weather conditions, etc.

As described above, the invention may be embodied in the form of computer implemented processes and apparatuses for practicing those processes. Embodiments of the invention may also be embodied in the form of computer program code containing instructions embodied in tangible media, such as floppy diskettes, CD-ROMs, hard drives, or any other computer readable storage medium, wherein, when the computer program code is loaded into and executed by a computer, the computer becomes an apparatus for practicing the invention. An embodiment of the invention can also be embodied in the form of computer program code, for example, whether stored in a storage medium, loaded into and/or executed by a computer, or transmitted over some transmission medium, such as over electrical wiring or cling, through fiber optics, or via electromagnetic radiation, wherein, when the computer program code is loaded into and executed by a computer, the computer becomes an apparatus for practicing the invention. When implemented on a general-purpose microprocessor, the computer program code segments configure the microprocessor to create specific logic circuits.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the application.

What is claimed is:

1. A system, comprising:

a computer processor communicatively coupled to an audio system in a vehicle, the audio system rendering a first instance of a content item, the content item received from a content provider, as a source of content, over a network; and logic executable by the computer processor, the logic configured to cause the processor to perform:

determining alternative sources of content that are communicatively available to the vehicle, including monitoring short range wireless signals for a presence of a wireless device in the vehicle;

determining a signal quality trigger event;

anticipating a time of an interruption in a signal from the content provider based on the signal quality trigger event;

determining a location in the first instance of the content item when the time of the interruption will occur;

searching the alternative sources of content for the content item to identify a second instance of the content item and a plurality of alternative content items; and upon arrival of the time of the interruption in the signal from the content provider with respect to the instance of the content item:

presenting the second instance of the content item, through the audio system, from the wireless device by causing an application of wireless device to stream the second instance of the content item at the location, and when the second instance of the content item is not identified:

displaying via a user interface the plurality of alternative content items, receiving an input via the user interface screen in the vehicle, the input identifying a replacement content item selected from the plurality of alternative content items, and presenting the replacement content item through the audio system, from the wireless device by causing the application of wireless device to stream the alternative content item in response to the receiving of the input.

2. The system of claim 1, wherein wherein presenting the alternative content item from one of the alternative sources of content includes presenting another instance of the same content item based on the identification.

3. The system of claim 2, wherein the identification is determined by metadata received from the content provider and the alternative sources of content.

4. The system of claim 1, wherein the determining alternative sources of content that are available to the vehicle includes scanning broadcast signals external to the vehicle through a wireless interface in the vehicle.

5. The system of claim 1, wherein the determining alternative sources of content that are available to the vehicle includes identifying any connection through the audio system to a digital media player in the vehicle, and requesting a content listing associated with content stored by the digital media player.

6. The system of claim 5, wherein the wireless interface includes an onboard navigation system.

7. The system of claim 1, wherein the wireless device is a smart phone or a Wi-fi-enabled radio integrated with the audio system in the vehicle.

8. The system of claim 1, wherein the logic with respect to determining the signal quality trigger event is further configured to implement:

determining a geographic location and direction of movement of the vehicle from global positioning system data derived via an onboard navigation system;

identifying a physical barrier as the signal quality trigger event to the signal along a route associated with the geographic location and the direction.

9. The system of claim 1, wherein the content item is a song.

10. A method, comprising:

determining, via a computer processor communicatively coupled to an audio system in a vehicle, including monitoring short range wireless signals for a presence of a wireless device in the vehicle, alternative sources of content that are communicatively available to the vehicle, the audio system rendering instance first instance of a content item, the content item received from a content provider, as a source of content, over a network;

determining a signal quality trigger event;

anticipating a time of an interruption in a signal from the content provider based on the signal quality trigger event;

determining a location in the first instance of the content item when the time of the interruption will occur;

searching the alternative sources of content for the content item to identify a second instance of the content item and a plurality of alternative content items; and upon arrival of the time of the interruption in the signal from the content provider with respect to the instance of the content item:

presenting the second instance of the content item, through the audio system, from the wireless device by causing an application of wireless device to stream the second instance of the content item at the location, and when the second instance of the content item is not identified:

displaying via a user interface the plurality of alternative content items, receiving an input via the user interface screen in the vehicle, the input identifying a replacement content item selected from the plurality of alternative content items, and presenting the replacement content item through the audio system, from the wireless device by causing the application of wireless device to stream the alternative content item in response to the receiving of the input.

11. The method of claim 10, wherein presenting the alternative content item from one of the alternative sources of content includes presenting another instance of the same content item based on the identification.

12. The method of claim 11, wherein the identification is determined by metadata received from the content provider and the alternative sources of content.

13. The method of claim 10, wherein the determining alternative sources of content that are available to the vehicle includes at least one of:

scanning broadcast signals external to the vehicle through a wireless interface in the vehicle;

identifying any connection through the audio system to a digital media player in the vehicle, and requesting a content listing associated with content stored by the digital media player; and monitoring short range wireless signals for a presence of the wireless device in the vehicle, and requesting a content listing from the wireless device.

14. The method of claim 13, wherein the wireless device is at least one of:

a smart phone; and a Wi-fi-enabled radio integrated with the audio system in the vehicle.

15. The method of claim 10, the determining of the signal quality trigger event further comprising:

determining a geographic location and direction of movement of the vehicle from global positioning system data derived via an onboard navigation system;

identifying a physical barrier as the signal quality trigger event to the signal along a route associated with the geographic location and the direction.

16. A computer program product comprising a non-transitory computer readable storage medium having instructions embodied thereon, which when executed by a computer processor, cause the computer processor to perform:

determining alternative sources of content that are communicatively available to a vehicle, including monitoring short range wireless signals for a presence of a wireless device in the vehicle, the computer processor communicatively coupled to an audio system in the vehicle, the audio system rendering a first instance of a content item, the content item received from a content provider, as a source of content, over a network;

determining a signal quality trigger event;

anticipating a time of an interruption in a signal from the content provider based on the signal quality trigger event;

determining a location in the first instance of the content item when the time of the interruption will occur;

searching the alternative sources of content for the content item to identify a second instance of the content item and a plurality of alternative content items; and upon arrival of the time of the interruption in the signal from the content provider with respect to the instance of the content item:

presenting the second instance of the content item, through the audio system, from the wireless device by causing an application of wireless device to stream the second instance of the content item at the location, and when the second instance of the content item is not identified:

displaying via a user interface the plurality of alternative content items, receiving an input via the user interface screen in the vehicle, the input identifying a replacement content item selected from the plurality of alternative content items, and presenting the replacement content item through the audio system, from the wireless device by causing the application of wireless device to stream the alternative content item in response to the receiving of the input.

17. The system of claim 1, wherein the application is an internet radio application that streams an internet station as the alternative content item.

18. The system of claim 1, wherein the anticipating of the time of the interruption in the signal from the content provider is based a geographic location and current speed of a vehicle in reference to the signal quality trigger event.

* * * * *